US006065484A

United States Patent [19]

Bartel et al.

[11] Patent Number: 6,065,484

[45] Date of Patent: May 23, 2000

[54] BURNER AND PILOT VALVE SAFETY CONTROL SYSTEM

[75] Inventors: Nathan G. Bartel, Hutchinson; Randall G. Batt, Wichita, both of Kans.

[73] Assignee: FMC Corporation, Chicago, Ill.

[21] Appl. No.: 09/106,239

[22] Filed: Jun. 29, 1998

[51] Int. Cl.[7] ..... F23D 5/16

[52] U.S. Cl. ..... 137/66; 431/54

[58] Field of Search ..... 137/66, 65; 431/54, 431/52, 51, 81

[56] References Cited

U.S. PATENT DOCUMENTS

| | | | |
|---|---|---|---|
| 2,988,098 | 6/1961 | Thomas | 137/66 |
| 3,451,407 | 6/1969 | Fairley et al. | 137/66 |
| 3,574,308 | 4/1971 | Battersby | 137/66 |
| 4,437,830 | 3/1984 | Harris et al. | 137/65 |
| 5,718,256 | 2/1998 | Buezis et al. | 137/66 |
| 5,785,511 | 7/1998 | Shah | 137/65 |
| 5,890,037 | 3/1999 | Kukimoto et al. | 355/200 |

*Primary Examiner*—Gregory L. Huson
*Assistant Examiner*—Joanne Y. Kim
*Attorney, Agent, or Firm*—Henry C. Query, Jr.

[57] ABSTRACT

The invention is an improved pilot valve for controlling the flow of gaseous fuel to both a pilot burner and a main burner, the pilot valve comprising a housing having an inlet part, a pilot port and a main burner port; a bore extending through the housing between the pilot port and main burner port; a stop shuttle normally biased to a seated position in which it blocks communication between the inlet port and the bore; a reset shuttle positioned in the bore for lifting the stop shuttle from its seated position, the reset shuttle supporting a sealing member for sealing the inlet port from the main burner port but permitting communication between the inlet port and the pilot port when the reset shuttle lifts the stop shuttle from its seated position; a thermocouple capable of generating a voltage from the heat of the pilot burner; and an electromagnet connected to the thermocouple and capable, when fully energized, of holding the stop shuttle from moving to its seated position; wherein the reset shuttle is movable by the force of gas pressure from the inlet port to a position in which the sealing member permits both the main burner port and the pilot port to communicate with the inlet port.

16 Claims, 2 Drawing Sheets

BURNER AND PILOT VALVE SAFETY CONTROL SYSTEM

The present invention relates to the safety control of a main burner and its pilot burner by interlocking the fuel supplies to both burners. More particularly, the invention relates to supplying the pilot and main burners in series from a common fuel supply through a valve system manually initiated and automatically maintained in its "run" position.

Automatic safety systems employing pilot valves are often used to control burners within fired equipment, such as to heat crude oil that has been collected in tanks in order to facilitate the separation of water droplets from the crude, which are deployed in remote locations and are unattended, except for initial startup and periodic inspection. (The word "control" as used herein simply means on-off accessibility to the fuel supply, i.e., access to the fuel supply is permitted in the "on" position and is precluded in the "off" position. Whether fuel is actually directed to the main burner is determined by another valve, responsive to its own thermostat, interposed between this burner and the pilot valve.) Such systems for both the pilot and main burner are required to avoid accumulation within the fired equipment of raw fuel discharged by unlit burners in volumes sufficient to be an explosive hazard. While the removal of water droplets is desirable in any event, it is necessary in cold climates to preclude the possibility of water collecting in low points in the lines and freezing, creating the possibility of leaks and/or blockages in the lines. Because the collection tanks are remotely located, a source of electrical power is often unavailable, or if available, is not reliable. To avoid reliance on electrical power in a control means, prior art pilot valves have utilized materials, such as mercury, which expand greatly when heated. Such arrangements are not desirable because the materials are often toxic, are susceptible to leakage, and because they have a relatively large mass from which heat must be dissipated after the removal of heat, do not react rapidly to failure of the flame being sensed. Even those prior art devices that did use a thermocouple provided no means for emergency shutdown or means for testing the operation of the safety system.

The present invention provides a pilot valve having a stop shuttle normally biased to a seated position to completely block communication with a source of natural gas under pressure and a reset shuttle movable to a reset or start up position in which is unseats the stop shuttle while simultaneously permitting communication of the pilot burner with the gas source and blocking communications with the main burner. A reset latch is arranged to hold the reset shuttle in its reset position until released. A thermocouple capable of producing a voltage output proportional to its temperature is heated by the flame of the pilot burner and is connected to an electromagnet. The electromagnet, when fully energized, holds the stop shuttle in its unseated position. When the reset latch is released, the reset shuttle is then moved by the force of the gas pressure to an operational position in which both the pilot and main burners are in communication with the gas source. A momentary contact switch is arranged, when depressed to its closed position, to short circuit the thermocouple. When the thermocouple is short circuited, the holding force of the electromagnet immediately deteriorates and the stop shuttle is instantly biased to its seated position blocking all communication with the gas source.

The objects of this invention are to provide a pilot valve which avoids the problems with, and shortcomings of the prior art; which simplifies the ignition process; which permits an instantaneous interruption of gas flow to both the main burner and the pilot burner; which interruption is effected by simply pushing a button; and which is relatively easy to manufacture, install and maintain. These and other objects of the present invention, and many of the attendant attributes thereof, will become more readily apparent from a perusal of the following detailed description and the accompanying drawings, wherein:

Figure 1:
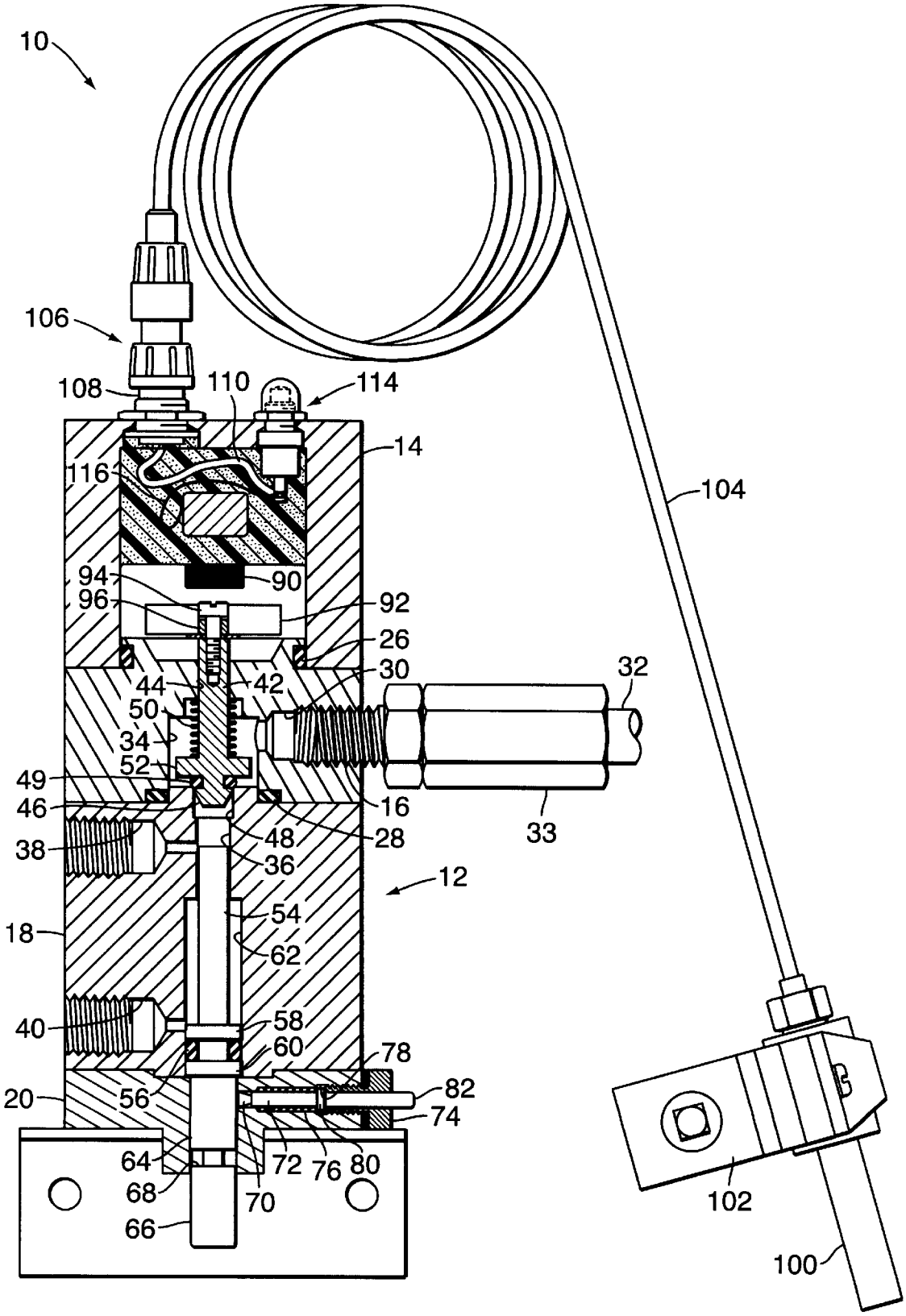
FIG. 1 is an elevational cross section of a pilot valve for use in an automatic safety control system according to the present invention.
Figure 2:
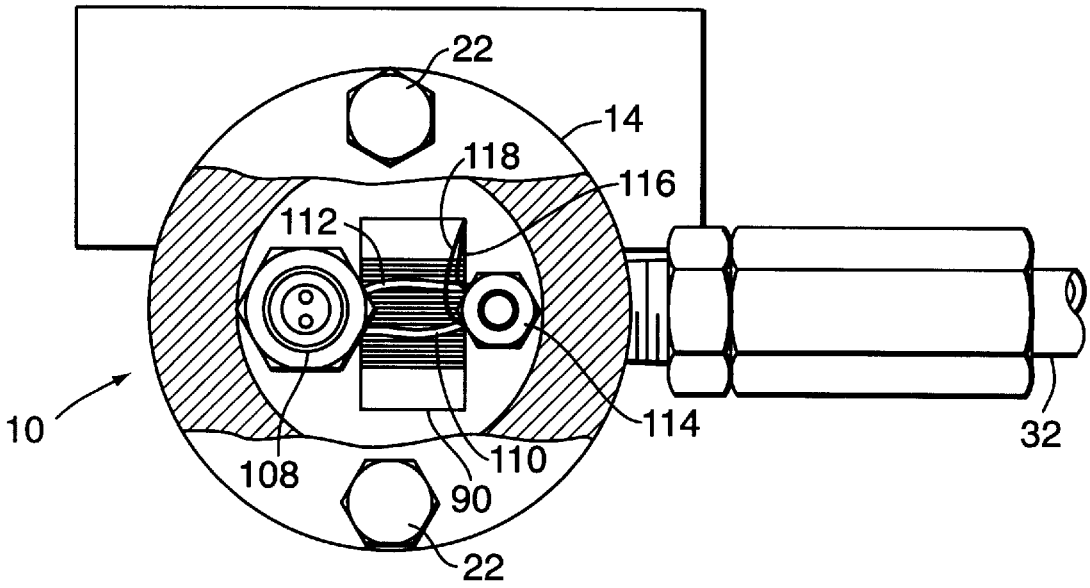
FIG. 2 is a top plan view of the valve shown in FIG. 1 with portions thereof broken away for clarity.
Figure 3:
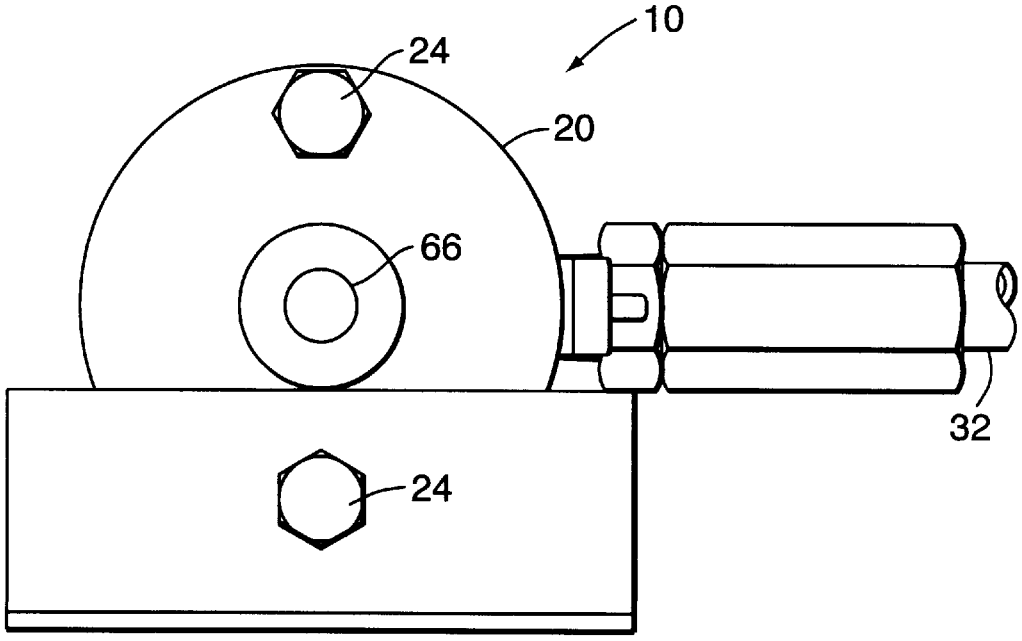
FIG. 3 is a bottom plan view of the pilot valve shown in FIG. 1.

Referring to FIG. 1, there is shown a pilot valve indicated generally at 10, having a body 12, which for ease of manufacture and assembly is composed of an electromagnet housing 14, an inlet disc 16, an output disc 18, and a bottom cover disc 20 all of which are joined together as a unitary structure by screws 22, shown in FIG. 2, that extend through aligned holes in the electromagnet housing 14 and the inlet disc 16 to engage tapped holes in the output disc 18, and by screws 24, shown in FIG. 3, that extend through holes in the bottom cover disc 20 to engage the same tapped holes.

An O-ring seal 26 positioned in a peripheral groove in the inlet disc 16 contacts the inner diameter of the electromagnet housing 14 to prevent the escape of gas between the housing 14 and the inlet disc 16. Another O-ring seal 28 is positioned between the output disc 18 and the inlet disc 16 to prevent the escape of gas between the adjacent surfaces of the inlet and output discs 16 and 18 respectively. The inlet disc 16 is provided with an inlet port 30 which is arranged in a conventional manner to connect with a natural gas supply line 32 through an in-line filter 33, which may be any of the commercially available types, such as a sintered bronze filter, for example, for removal of water and solid contaminates that could otherwise interfere with the proper operation of the pilot valve 10. The inlet port 30 communicates with a central cavity 34 formed in the inlet disc 16. A central longitudinal bore 36 in the outlet disc 18 communicates with the cavity 34 and with a pilot port 38 and a burner port 40. A stop shuttle 42 extends through and reciprocates in a central bore 44 in the inlet disc 16. The lower end 46 of the shuttle 42 is frusto-conically shaped for engagement with a counterbore 48 to assure alignment of the longitudinal axis of the shuttle 42 with the bore 36. An O-ring 49 carried in a groove in the shuttle 42 is engageable with the intersection of the counterbore 48 with the upper surface of the output disc 18 to block communication between the cavity 34 and the bore 36. A compression spring 50 trapped between the inlet disc 16 and a collar 52 on the shuttle 42 urges the O-ring 49 into sealing engagement with the outlet disc 18. As the O-ring 49 is deformed by the force of the spring, i.e., takes a permanent set, the lower end 46 will simply travel downward further, so the sealing capability of the O-ring 49 is retained.

A reset shuttle 54 is reciprocal in the bore 36 but with sufficient clearance to permit an adequate flow of gas therebetween to provide the fuel requirement of both the pilot and main burners. An O-ring seal 56 is carried between lands 58 and 60 formed on the reset shuttle 54, which lands 58 and 60 engage and reciprocate in a counterbore 62. The engagement of the lower land 60 with the upper surface of the bottom cover disc 20 limits the downward travel of the reset shuttle, in which position the seal 56 is below the main burner port 40 permitting communication of the bore 36 with the port 40. An extension 64 is formed on the reset shuttle 54 and extends through a bore in the bottom cover disc 20, the lower end of which protrudes to function as a reset button 66. Pushing upward on the reset button 66 first causes the O-ring 56 to isolate the burner port 40 and then the upper face of the shuttle 54 to engage the end 46 to push the stop shuttle 42 upward, against the bias of the spring 50, disengaging the O-ring 49 from its seat. Communication between the inlet port 30 and the pilot port 38 is thereby established.

A groove 68 is formed in the extension 64 and is engageable by the inner end 70 of a latch pin 72 which is reciprocably retained in a radial bore in the bottom cover disc 20 by a bushing 74 screwed into a threaded counterbore 78 in the disc 20. A compression spring 76 trapped between the bottom of the counterbore 78 and a collar 80 formed on the latch pin 72 urges the pin 72 toward the right, as viewed in FIG. 1, so that the inner end of the latch pin 72 clears the extension 64 and the opposite end thereof protrudes beyond the bushing 74 to function as a latch button 82. The inner end 70 of the latch pin 72 has a frustroconical shape with the largest diameter at the extreme end thereof. A complementary shape is provided to the upper surface of the groove 68 so that the force of the compression spring 50 will retain the inner end 70 of the latch pin 72 within the groove 68, when upward manual force on the reset button 66 is released before the release of inward manual force on the latch button 82, to hold the reset shuttle 54 in the raised position previously described, i.e., with the inlet port 30 in communication with the pilot port 38 but with the main burner port 40 isolated from the inlet port 30. Gas is thereby permitted to flow to the pilot but not to the main burner. Subsequently manually pushing the reset button 66 upward, without any force being applied to the latch button, will permit compression spring 76 to release the end 70 from the groove 68. Upon release of such upward manual force on the reset button 66, the downward force of the gas pressure acting on the reset shuttle 54 will cause the shuttle to move downward until the land 60 engages the upper surface of the bottom disc cover. In this position of the reset shuttle 54, the bore 36 is in communication with both ports 38 and 40. Gas would thereafter be supplied to both ports if, and only if, the stop shuttle 42 did not move downward under the force of the compression spring 50 so that the O-ring seal 49 precludes communication between the inlet port 30 and the bore 36.

The stop shuttle 54 will move downward only if a horseshoe electromagnet 90 is not energized. A disc 92, which preferably is made of a ferrite material, is attached to the top of the stop shuttle 42 by a screw 94 extending through a spacer bushing 96 glued to a central opening therein. When the electromagnet is energized, the disc 92 will be held by magnetic attraction thereagainst, holding the stop shuttle 54 in its upward, open position against the bias of the spring 50. Under such conditions, natural gas will be permitted to flow from the inlet port to both the pilot port 38 and main burner port 40. The electromagnet 90 is energized by a thermocouple 100 which is held by a suitable bracket 102 in a position to be heated by the flame of the pilot burner, not shown. Lead wires from the thermocouple 100 extend through a flexible sleeve 104 and terminate in a connector 106 which mates with a complementary socket 108 secured to the top of the electromagnet housing 14. The lead wires from the thermocouple 100 connect with wires 110 and 112, as seen in FIG. 2, leading from the socket to separate ones of the two terminals of a monetary contact switch 114. Wires 116 and 118 from the windings of the electromagnet 90 are also connected separately to the terminals of the switch 114. Depressing the contact switch 114 will electrically connect wires 110 and 112 causing them to be short circuited and de-energizing the electromagnet 90. When the thermocouple 100 is heated by the flame of the pilot burner, it will generate a voltage which will cause the electromagnet to be energized, thereby permitting the electromagnet 90 to hold the stop shuttle in its upper position. Thus, natural gas will be provided to both the main burner and the pilot burner. If, for any reason, the switch 114 is depressed, the electromagnet 90 will be de-energized permitting the spring 50 to move the stop shuttle 42 downward to seal the inlet port 30 from both the pilot port 38 and the main burner port 40. Of course, if the pilot flame is extinguished, the thermocouple is not positioned properly or the thermocouple is defective, no voltage will be generated to energize the electromagnet 90. Under any of those conditions, gas can never be supplied to the main burner port 40.

It has been discovered that using sintered metal oxide ferrite for both the disc 92 and the core of the horseshoe electromagnet 90 will produce a magnetic force sufficient to hold the stop shuttle 42 against the bias of the spring 50 even at the low voltage and current output of a conventional thermocouple. With such use of sintered metal oxide ferrite, a thermocouple producing a current of 160 milliamps at a voltage of 600 to 750 millivolts for energizing windings of the electromagnet 90 that has been found to provide a force of at least 2.5 pounds of force when the disc 92 is physically in contact with the ends of the core for the horseshoe magnet 90, which force is more than sufficient to exceed the bias of spring 50. While the pull-in force, i.e., the magnetic force attracting the disc 92 toward the magnet 90 when an air gap exists between them, with the described arrangement is small, the holding force, i.e., the magnetic force generated when these two elements are in contact with each other, has been found to be quite large. The reason is that, when in contact, the disc 92 completes a magnetic circuit between the ends of the horseshoe, efficiently transferring the magnetic flux therebetween. Holding force, rather than pull-in force, is important since the disc 92 will be moved into contact with the ends of the electromagnet by the manual upward movement of the reset button 66 to permit release of the latch pin 72. The groove 68 is positioned so that when the end 70 of the latch pin 72 is in engagement therewith a small air gap exists between the disc 92 and the ends of the electromagnet 90. Subsequent manual upward movement of the reset button 66, which is necessary to release the latch pin 72, will close this gap.

The pilot valve 101 with the thermocouple 100 properly positioned by attachment of the bracket 102 to be heated by the flame of a pilot burner, is placed in operation by initially introducing an ignition source adjacent the pilot burner. The reset button 66 is then depressed, i.e., manually moved upwardly, while simultaneously depressing the latch button 82, i.e., manually urging the latch button inward. When the operator feels the inner end 70 move into the groove 68, the reset button 66 is released, while pressure on the latch pin is, at least momentarily, maintained. The engagement of the tapered end 70 with the upper surface of the groove 68 will retain the latch pin 72 in the groove 68 holding the reset shuttle 54 in an elevated position in which the stop shuttle 42 is unseated and only the pilot port 38 is provided with gas. The force of the gas pressure acting on the reset shuttle 54 and the force of the spring 50 will retain the end 70 within the groove. Once the thermocouple 100 is heated, the reset button 66 is depressed again, with no force being applied to the latch button. The spring 76 will cause the latch pin to move outward extracting the end 70 from the groove 68 and allowing gas pressure to move the reset shuttle 54 downward connecting both the pilot port 38 and the main burner port 40 to be supplied with gas. Of course, this assumes the thermocouple 100 has produced sufficient voltage to energize the electromagnet 90 in order for magnetic force to hold the stop shuttle 42 in its unseated position. If the pilot flame has failed, or if the thermocouple is defective or improperly positioned, the spring 50 will immediately return the stop shuttle 42 to its seated position blocking all communication with the gas source. At any time during operation of the pilot valve, depressing the switch 114 will de-energize the electromagnet 90 permitting the stop shuttle 42 to immediately move to its seated position.

While a preferred embodiment of the present invention has been illustrated and described herein, it is to be understood that various changes may be made therein without departing from the spirit of the invention, as defined by the scope of the appended claims.

What is claimed is:

1. An improved pilot valve for controlling the flow of gaseous fuel to both a pilot burner and a main burner comprising:

a housing having an inlet port, a pilot port, and a main burner port;

a bore extending through said housing between said pilot port and said main burner port;

a stop shuttle normally biased to a seated position in which it blocks communication between said inlet port and said bore;

a reset shuttle positioned in said bore for lifting said stop shuttle from its seated position, said reset shuttle supporting a sealing member for sealing the inlet port from the main burner port but permitting communication between said inlet port and said pilot port when said reset shuttle lifts said stop shuttle from its seated position;

a thermocouple capable of generating a voltage from the heat of the pilot burner;

an electromagnet connected to said thermocouple and capable, when fully energized, of holding said stop shuttle from moving to its seated position; and said reset shuttle being movable by the force of gas pressure from said inlet port to a position in which said sealing member permits both said main burner port and said pilot port to communicate with said inlet port.

2. The invention according to claim 1, and further comprising a disc secured to said stop shuttle and made of a material capable of being magnetically held by said electromagnet when energized.

3. The invention according to claim 2, wherein said material is ferrite.

4. The invention according to claim 3 wherein said electromagnet has a horseshoe-shaped core made of a ferrite material.

5. The invention according to claim 4 wherein said ferrite material is a sintered metal oxide ferrite.

6. The invention according to claim 2 wherein said material is sintered metal oxide ferrite.

7. The invention according to claim 1 and further comprising:

a momentary contact switch interposed between said thermocouple and said electromagnet to short circuit said thermocouple and de-energize said electromagnet.

8. The invention according to claim 1 and further comprising:

a latch pin for engagement with said reset shuttle to hold said reset shuttle in its unseated position.

9. The invention according to claim 8 and further comprising:

a spring for normally biasing said latch pin to an outward position out of engagement with said reset shuttle.

10. The invention according to claim 9 wherein said latch pin has a tapered inner end and said reset shuttle has a groove with a surface complementary to said end for holding the latch pin against the bias of said spring.

11. The invention according to claim 9, wherein said disc is spaced from said electromagnet when said latch pin is in engagement with said reset shuttle and subsequent upward movement of said reset shuttle brings said disc into contact with said electromagnet while simultaneously permitting said latch pin to disengage from said reset shuttle.

12. An improved pilot valve for controlling the flow of gaseous fuel to both a pilot burner and a main burner comprising:

a housing having an inlet port, a pilot port, and main burner port;

a bore extending through said housing between said pilot port and said main burner port;

a stop shuttle normally biased to a seated position in which it blocks communication between said inlet port and said bore, a reset shuttle, including a reset button for manual depression, for lifting said stop shuttle from its seated position, said reset shuttle supporting a sealing member for sealing the inlet port from the main burner port but permitting communication between said inlet port and said pilot port when said reset button is depressed;

a reset latch pin, including a latch button for manual depression, normally biased out of engagement with said reset shuttle, wherein depression of said latch button while releasing said reset button maintains said reset shuttle lifted from its seated position;

a thermocouple capable of generating a voltage from the heat of the pilot burner;

an electromagnet connected to said thermocouple and capable, when fully energized, of holding said stop shuttle from moving to its seated position; and wherein subsequent depression of said reset button without depressing said latch button permits said latch pin to move out of engagement with said reset shuttle and permits the force of gas pressure from said inlet port to move said reset shuttle to a position in which both said main burner port and said pilot port are in communication with said inlet port.

13. The invention according to claim 12, wherein:

said electromagnet has a horseshoe-shaped core;

a disc is secured to said stop shuttle for engagement with said core; and said disc is made of a material to efficiently transfer magnetic flux between the ends of said core.

14. The invention according to claim 13, where said core is made of sintered metal oxide ferrite.

15. The invention according to claim 12, wherein said disc material is sintered metal oxide ferrite.

16. The invention according to claim 12 and further comprising:

a momentary contact switch connected to short circuit said thermocouple and thereby de-energize said electromagnet and isolate said inlet port.

* * * * *